United States Patent [19]

Sato

[11] 4,119,831

[45] Oct. 10, 1978

[54] CONTACT PRESSURE ADJUSTING DEVICE IN HEATING PRESSING FIXING APPARATUS FOR ELECTROPHOTOGRAPHIC COPIERS

[75] Inventor: Takashi Sato, Ebina, Japan

[73] Assignee: Rank Xerox, Ltd., London, England

[21] Appl. No.: 778,824

[22] Filed: Mar. 14, 1977

[51] Int. Cl.[2] ..... H05B 1/00

[52] U.S. Cl. ..... 219/216; 219/388; 219/469; 432/60; 432/228

[58] Field of Search ..... 219/216, 388, 469–471; 355/3 FU; 432/60, 228; 100/93 RP, 155 R, 163 R, 164–166, 168

[56] References Cited

U.S. PATENT DOCUMENTS

| | | | |
|---|---|---|---|
| 3,861,863 | 1/1975 | Kudji | 219/216 X |
| 3,874,843 | 4/1975 | Fujimoto | 219/216 X |

*Primary Examiner*—C. L. Albritton

[57] ABSTRACT

A contact pressure adjusting device in a combination heating and pressing fixing apparatus for electrophotographic copiers, characterized in that one end of a spring 3, which applies a pressing force to a heating roll 1 and a press roll 2, is mounted on a rotary plate 4 so as to vary the spring load as said rotary plate 4 is rotated to various positions.

3 Claims, 3 Drawing Figures

CONTACT PRESSURE ADJUSTING DEVICE IN HEATING PRESSING FIXING APPARATUS FOR ELECTROPHOTOGRAPHIC COPIERS

BACKGROUND OF THE INVENTION

This invention relates to a contact pressure adjusting device in a heating and pressing fixing apparatus for electrophotographic copiers.

In the past, a heating and pressing fixing apparatus of the kind contemplated has been designed so that a heating roll and a press roll are rotatably brought into pressure contact with each other, and a copy paper is fixed as the paper passes between the heating roll and the press roll by the toner images carried by the paper contacting the heating roll.

There are many devices, in which contact pressure between the heating roll and the press roll is constant, while some devices are designed so that the stroke produced by a cylinder or solenoid may manually be varied to vary and adjust the contact pressure.

In either case, however, the contact pressure cannot be adjusted in a simple procedure, and hence, an adequate value of the contact pressure in accordance with variation in kind of paper quality cannot be achieved, resulting in inconveniences such as the lowering of copy quality and occurrence of paper wrinkle.

The present invention has been realized in view of circumstances noted above, and it is an object of the invention to provide a contact pressure adjusting decice in a heating and pressing fixing apparatus for electrophotographic copiers, which can adjust contact pressure automatically in a simple manner such as by pushing a button selector.

Other objects and advantages of the present invention will become apparent when read in conjunction with the accompanying drawings wherein.

DETAILED DESCRIPTION OF THE PROPOSED EMBODIMENT

Figure 1:
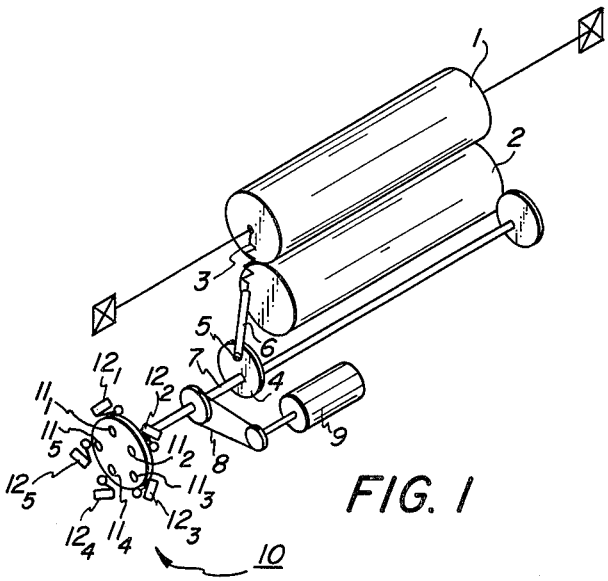
FIG. 1 is a perspective view showing the entire structure.

An embodiment of the present invention will now be described with reference to the drawings.

A heating roll 1 and a press roll 2 are rotatably placed in contact under pressure.

The nip $h$ between the heating roll 1 and the press roll 2 is given by $$h = 2\sqrt{(3/2)\cdot(WD/\pi E)}$$

where, $W$ represents the pressing force per unit, $D$ is the diameter of roll, and $E$ is the Young's modules.

It is found from the above equation that the nip $h$ varies in proportion to the pressing force W provided that the hardness of rubber of the pressing roll, the diameter of roll, the thickness of rubber and the Young's modulus E are constant.

Thus, a spring 3 for applying the pressing force W is retained on a rod 6 pivoted by a pin 5 in an eccentric position of a rotary plate 4 so that a spring load of the spring 3 may be varied by rotation of the rotary plate 4 at an angle as fixed.

The rotary plate 4 has a shaft 7, to which is connected a drive source 9 through a transmission mechanism 8, and the shaft 7 has a cam plate 10 fixed thereto. First to fifth cams $\mathbf{11}_1$, $\mathbf{11}_2$, $\mathbf{11}_3$, $\mathbf{11}_4$, and $\mathbf{11}_5$ are projectively mounted on the cam plate 10 in spaced relations in the direction of rotation, and first to fifth microswitches $\mathbf{12}_1$, $\mathbf{12}_2$, $\mathbf{12}_3$, $\mathbf{12}_4$, and $\mathbf{12}_5$, are positioned opposite to the cams 11, respectively.

Figure 2:
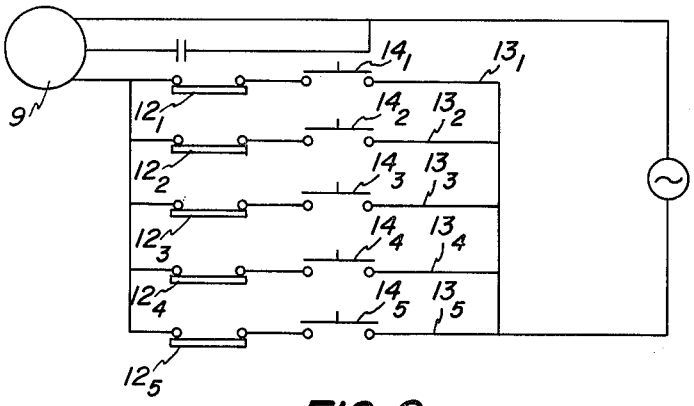
FIG. 2 is a starting electric circuit of a drive source.
Figure 3:
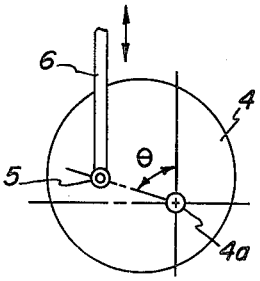
FIG. 3 is a view of rotary plate which serves as part of the mechanism for applying a varying pressure between the rolls.

The microswitches 12 are normally closed but opened only when they come into contact with the cams 11, and as shown in FIG. 2, these microswitches are connected to starting electric circuits $\mathbf{13}_1$, $\mathbf{13}_2$, $\mathbf{13}_3$, $\mathbf{13}_4$, and $\mathbf{13}_5$, which are provided with push button switches $\mathbf{14}_1$, $\mathbf{14}_2$, $\mathbf{14}_3$, $\mathbf{14}_4$, and $\mathbf{14}_5$, respectively, connected in series.

In operation, when the first push button switch $\mathbf{14}_1$ is turned ON, the drive source 9 is driven to rotate the shaft 7 through the transmission mechanism 8. When the shaft 7 is rotated, the cam plate 10 is rotated, and when the first cam $\mathbf{11}_1$, comes into contact with the first microswitch $\mathbf{12}_1$, the first microswitch $\mathbf{12}_1$, opens to deenergize the starting electric circuit $\mathbf{13}_1$, thus stopping the drive source 9. Hence, the shaft 7 is stopped in a position at an angle formed between the first cam $\mathbf{11}_1$ and the first microswitch to rotate the rotary plate 4 by that angle, as a consequence of which an angle $\theta$ between the pivot pin 5 of the rod 6 and the center 4*a* of the rotary plate assumes an angle as fixed, whereby the spring load of the spring 3 will have the value corresponding to the angle $\theta$ and at the same time the pressing force will also have the value corresponding thereto so that the contact pressure between the heating roll 1 and the press roll 2 may be determined.

In a similar manner to the former, when the second through fifth push button switches $\mathbf{13}_2$ through $\mathbf{13}_5$ are turned ON, the rotary plate 4 stops after rotation by the angle corresponding to the contact position between the second through fifth cams $\mathbf{11}_2$ through $\mathbf{11}_5$ and the second through fifth microswitches $\mathbf{12}_2$ through $\mathbf{12}_5$, respectively, so that the spring load of the spring 3 will have the value corresponding to the respective angle, and the contact pressure between the heating roll 1 and the press roll 2 will have a different value.

According to the above-mentioned embodiment, therefore, when the push button switches $\mathbf{14}_1$, $\mathbf{14}_2$, $\mathbf{14}_3$, $\mathbf{14}_4$, and $\mathbf{14}_5$ are depressed, the contact pressure may be varied in value accordingly, so that the contact pressure in accordance with paper quality of copy paper may be obtained.

From the foregoing construction, it will be appreciated in the present invention that the contact pressure between the heating roll 1 and the press roll 2 may be adjusted in a simple operation, which merely requires rotating the rotary plate 4.

Therefore, the contact pressure may simply be obtained in accordance with paper quality of copy paper to be used to provide various effects such as improvement in copy quality and avoidance in occurrence of paper wrinkle.

While the invention has been described with respect to a preferred embodiment it will be apparent that certain modifications and changes may be made without departing from the spirit and scope of the invention and it is therefore intended that the foregoing disclosure be limited only by the claims appended hereto.

What is claimed is:

1. Apparatus for fixing toner images to copy paper or the like, said fuser apparatus comprising:

a first roll;

a second roll forming a nip with said first roll through which said copy paper passes;

means for applying variable pressure between said first and second rolls;

selection means corresponding to various pressures which can be applied between said rolls; and means operably coupling said variable pressure applying means with said selection means whereby different pressures can be applied between said rolls in accordance with said selection means, said variable pressure applying means comprising spring means operably coupled to a rotary plate in a manner so as to effect variable forces in accordance with the angular orientation of said plate and drive means coupled to said rotatable plate for positioning said plate in one of the plurality of positions in response to activation of said selection means, said selection means comprising switch means.

2. Apparatus according to claim 1 wherein said first roll is heated.

3. The apparatus according to claim 1 wherein said switch means comprises a plurality of push-button switches.

* * * * *